United States Patent [19]

Chen

[11] 4,404,930

[45] Sep. 20, 1983

[54] METHODS AND APPARATUS FOR TRANSFERRING LIQUID AGAINST HIGH PRESSURE RESISTANCE

[76] Inventor: Thomas Y. C. Chen, 40 Beacon Ave., Jersey City, N.J. 07306

[21] Appl. No.: 166,450

[22] Filed: Jul. 7, 1980

Related U.S. Application Data

[63] Continuation-in-part of Ser. No. 23,334, Mar. 23, 1979, Pat. No. 4,211,188, and a continuation-in-part of Ser. No. 841,490, Oct. 12, 1977, Pat. No. 4,165,718.

[51] Int. Cl.[3] ..... F22D 5/26

[52] U.S. Cl. ..... 122/451 R; 122/458

[58] Field of Search ..... 122/451 R, 452, 456, 122/457, 458

[56] References Cited

U.S. PATENT DOCUMENTS

| | | | |
|---|---|---|---|
| 759,660 | 5/1904 | Brazda | 122/457 |
| 977,841 | 12/1910 | Rollins | 122/456 |
| 2,011,626 | 8/1935 | Goff | 122/456 X |
| 2,325,241 | 7/1943 | Gilmore | 122/456 |
| 2,870,751 | 1/1959 | Kuljian et al. | 122/451 R |
| 3,116,876 | 1/1964 | Palm | 122/456 X |

*Primary Examiner*—Edward G. Favors

[57] ABSTRACT

Mechanical methods for reducing drastically the energy consumption of high pressure liquid pumping.

The basic method is to utilize high pressure vapor at the suction side of the pump to reduce the required pumping pressure head. The energy content of the high pressure vapor is returned or utilized. Disclosed high efficiency heat exchangers and expansion absorbing vessels are provided to reduce energy requirement for transferring liquid to a vapor generator, a high pressure apparatus and a extended pipe line.

4 Claims, 16 Drawing Figures

A
LIQUID RECEIVER
HIGH PRESSURE APPARATUS

METHODS AND APPARATUS FOR TRANSFERRING LIQUID AGAINST HIGH PRESSURE RESISTANCE

This application is a continuation in-part of my pending application, Ser. No. 023,334 filed Mar. 23, 1979 (now U.S. Pat. No. 4,211,188, issued Aug. 28, 1979); and my application pending therewith Ser. No. 841,490, filed Oct. 12, 1977 (now Pat. No. 4,165,718, issued Aug. 28, 1979).

This invention relates to method and apparatus for transferring liquid to a high pressure vapor generator, a high pressure apparatus, and an extended pipe line.

An object of this invention is to reduce greatly the energy consumption for pumping condensate into a high pressure vapor generator or for transferring liquid into an extended pipe line, such as a crude oil pipe line.

Another objective is to utilize disclosed high efficiency heat exchanger to heat condensate or liquid.

Another objective is to utilize disclosed pressure vessels with interior and exterior shells and thus, the service time of the vessels is much prolonged in comparison with single shell vessels.

Other objects, uses, and advantages will be obvious or apparent from a consideration of the following detailed description and the application drawings in which like reference numerals indicate like parts throughout the several views.

In the drawings:

FIG. 7 is also a fragmental sectional view showing a variation in the embodiment of FIGS. 2, 3, and 7.

Figures 5, 5A:
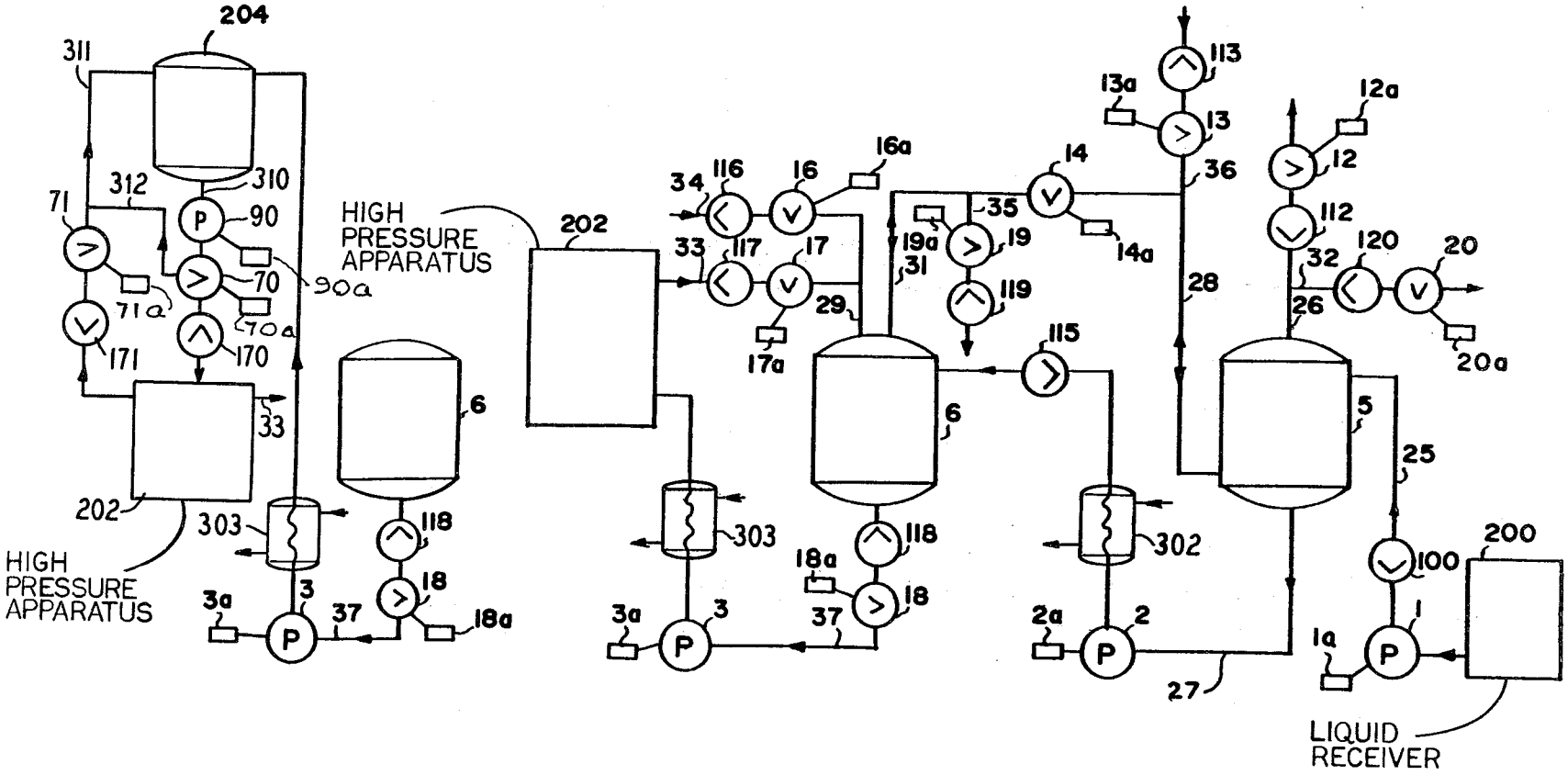
FIG. 5 is a view similar to that of FIG. 1 showing a modified arrangement of the embodiment of FIG. 1.
FIG. 5A is a fragmental view showing a variation in the embodiment of FIG. 5.

It is to be distinctly understood that the specific drawing illustrations provided are supplied primarily to comply with the requirements of the Patent Laws, and that the invention is susceptible of modifications that will be obvious to those skilled in the art, and that are intended to be covered by the appended claims. FIG. 5 is in common to my previous application Ser. No. 023334 (except a little different).

Referring to FIG. 5, the liquid (may be condensate) feeding system B of this embodiment comprises condensate receivers 5 and 6 that are constructed in pressure vessel form from suitable material, such as steel, that will withstand internal pressure of up to 8,000 PSIG., depending upon the operating pressure. In situations where the quantity of oxygen in the processed fluid is enough to cause rust, stainless steel having a thickness in the range of from approximately $\frac{1}{8}$th inch to approximately $\frac{1}{2}$ inch can be used at the inner surface of the shell of the vessels. Stainless steel piping and fittings can be used wherever it is financially feasible. All valves, except check valves, shown in FIGS. 1, 5 through 9, and 10 are of the gradually opened automatic type, other automatic or manual valves can be employed in parallel with any such automatic valve as a standby valve in case of emergency. One shut off valve shall be installed at each side of an automatic valve.

A condensate feed line 25 connects to the receiver 5 near its top and contains a check valve 100. A pump 1 in the feed line 25 is operative to pump condensate to the receiver 5 from a suitable source, such as vessel 200 (the condensate in vessel 200 being supplied, for instance, from steam operated turbines utilizing system B).

A vent line 26 extends upwardly from the top of the receiver 5 and contains a check valve 112 and a shut off valve 12. A branch line 32 extends from the line 26 to make available processing vapor for external work. The line 32 contains a shut off valve 20 and a check valve 120. The check valves 112 and 120 prevent fluid flow back into the vessel 5. A condensate discharge line 27 leads from the bottom of the receiver 5 (at fitting 27A, see FIG. 2) to the receiver 6 near the top thereof for feeding condensate into receiver 6. The line 27 contains a pump 2, a check valve 115, and a heat exchanger 302. Fluid (vapor, condensate, or both) inlet line 29 connects to the top of the receiver 6 and discharges into a distributor means which will be described hereinafter. The line 29 is supplied with fluid either from vapor generator 202 (represented by square) through the line 33 or with heating fluid through the line 34. These lines contain the respective shut off valves 16, 17, and check valves 116, 117, respectively.

A vapor discharge line 31 extends upwardly from the top of the receiver 6 for carrying vapor to the line 28. The line 31 contains shut off valve 14. The line 28 connects to receiver 5 near the bottom of same and serves to provide a way to equalize the pressures between receivers 5 and 6.

A branch line 35 extending from the line 31 serves as a source to supply vapor from receiver 6 to other processing equipment. Line 35 contains shut off valve 19 and check valve 119. Line 28 extends outwardly, as at 36, from the point where it connects line 31; line 36 connects to a source of heating fluid which may be vapor, condensate or a mixture of both (such source can be a turbine discharge in some cases). Line 36 extends from line 28 and contains shut off valve 13 and check valve 113 which permits flow only in the direction toward the receiver 5 from the indicated source of heating fluid.

Each of the lines 34, 35 and 36 for purposes of disclosure is intended to represent one fluid pipe or multiple fluid pipes in parallel, and each of said multiple pipes are to contain a shut off valve and a check valve identical to those shown for the respective lines 34, 35 and 36.

Line 37 extends from the bottom of the receiver 6 (as from fitting 37*a*, FIG. 2) to pump 3, which pumps condensate from the receiver 6 to the heat exchanger 303 and to force the heated condensate in the heat exchanger into the vapor generator 202. Line 37 contains shut off valve 18, check valve 118 and heat exchanger 303.

Figures 1, 1A, 1B, 1C:
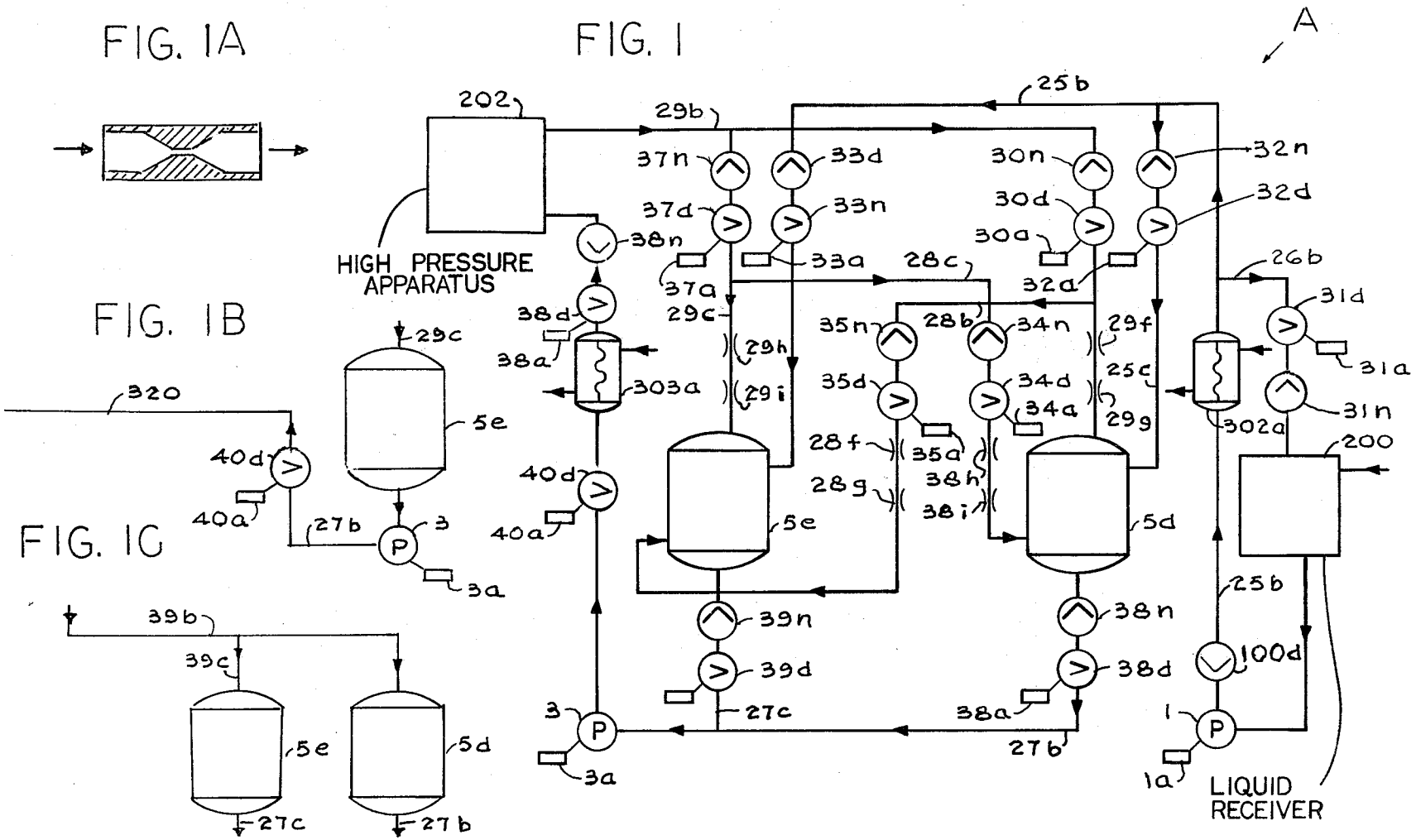
FIG. 1 is a diagrammatic representation of an energy saving liquid transferring system in accordance with the invention.
FIG. 1A is a diagrammatic sectional view of a flow modifier used in accordance with the invention.
FIG. 1B is a fragmental view showing a variation in the embodiment of FIG. 1.
FIG. 1C is a fragmental view showing a second modification of the embodiment of FIG. 1.
Figure 2:
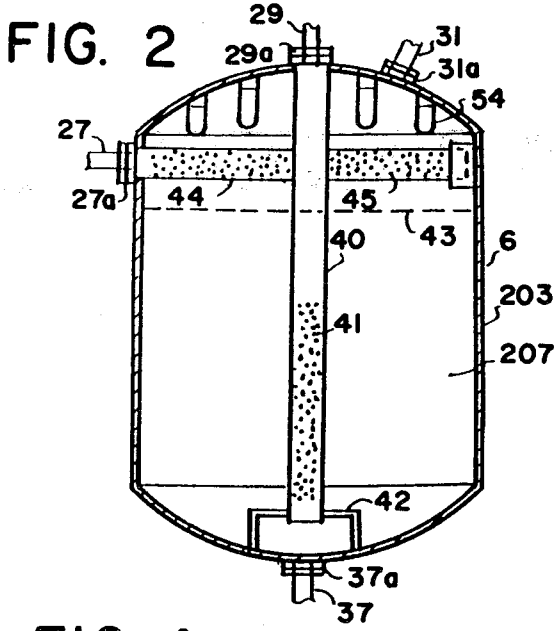
FIG. 2 is a diagrammatic elevational and sectional view of one of the basic energy saving pressure vessels which is usually connected to the last feeding pump, in accordance with the invention.

Referring now to FIG. 2, which shows a detailed section of receiver 6, it will be noted that the line 29 connects at fitting 29*a* to a vertically disposed distributor tube 40 having multiple openings 41 in the lower part of same. The lower end of the tube 40 is sealed and secured to the bottom of the vessel forming receiver 6 by means of suitable supports 42. The primary liquid level, indicated at 43, represents the lowest level to which the vessel or receiver 6 is to be filled with condensate. The line 31 (FIG. 1) connects with fitting 31*a* on the receiver 6, and the fitting 37*a* at the bottom of receiver 6 connects with line 37 (FIG. 1). A distributor 44 extends horizontally across the receiver 6 at the upper part of same and connects to the line 27 through the fitting 27*a*. Each of all said fittings is a fitting of an opening of the shell 203. The distributor 44 is in the form of tube 44*a* having multiplicity of holes 45 formed in same about its circumference, within receiver 6.

The receiver 6 also has affixes to its upper end one or more sprinkler devices 54 (see FIGS. 2, 4 and 4A); and each device 54 comprises a trough 54*a* having a multiplicity of holes 55 formed in and along the lower portion of same through which condensate supplied to sprinkler 54 is to flow by gravity to condensate heating vapor above level 43 in order to reduce the vapor pressure in vessel 6. The troughs 54*a* extend across the receiver and have their ends 56 suitably affixed to the receiver so that all condensate supplied to same drains out through holes 55. Condensate is supplied to the troughs 54*a* by their receiving condensate sprayed upwardly through distributor 44 when condensate is forced to distributor 44. Alternately, troughs 54*a* may be replaced by tubes or containers connected to an opening in the receiver shell. The tubes or containers may have vent openings at the top and multiple holes at the bottom for sprinkling. The sprinklers can be made of aluminum or stainles steel to meet the requirement of each application. A pump can be used for the sprinklers.

The distributor tubes 40 and 44 are made of stainless steel or extra hard tungsten alloy or equivalents so that they will adequately handle any pressurized fluid passing through the openings of same. They may be suitable fixed within the vessel 6 in their indicated positions. All parts inside the receiver should be so fastened to the wall of same in such a way that maximum expansion can be absorbed without causing any damage. The horizontal tube type distributor 44 can be supported by a larger drainable tube welded to the said wall. The end of the distributor is inside said drainable tube for free expansion. It is important that the outlet openings 41 in the distributor 40 be located below the primary liquid level 43 of the condensate in the receiver 6. Receiver 6 may contain two or more such distributors 40, as desired. The distributors 40 and 44 are arranged so that the only outlet for the vapor supplied to the receiver is through the openings 41 and 45.

Receiver 6 is basically defined by encompassing wall structure 203 suitably sealed and reinforced to withstand the operating pressure of any particular case.

The receiver 5 (FIG. 3) has at least a pair of horizontally disposed vertically spaced, tubular distributors 46 and 48 that contain openings 47 and 49 respectively distributed along the entire length of the respective distributor tubes 46 and 48 within receiver 5. The distributor tube 46, which is of the same general type as distributor 44 (FIG. 2), is connected with line 25 through fitting 25*a*. Distributor 48 located adjacent the bottom of the vessel forming receiver 5 is a tube similar to distributor 44 is connected with the line 28 through the fitting 28*a*. Line 26 is connected with the fitting 26*a* at the top of receiver 5, and the line 27 is connected with the fitting 27*a* at the bottom of receiver 5. Receiver 5 is also equipped with one or more of the sprinkler devices 54 that are operably associated with distributor 46 in the same manner as with distributor 44 of receiver 6.

Receiver 5, like receiver 6, is basically defined by encompassing wall structure 205 suitably sealed and reinforced to withstand the operating conditions contemplated by and particular application. Thermal insulation is required outside the wall 205.

Figure 3:
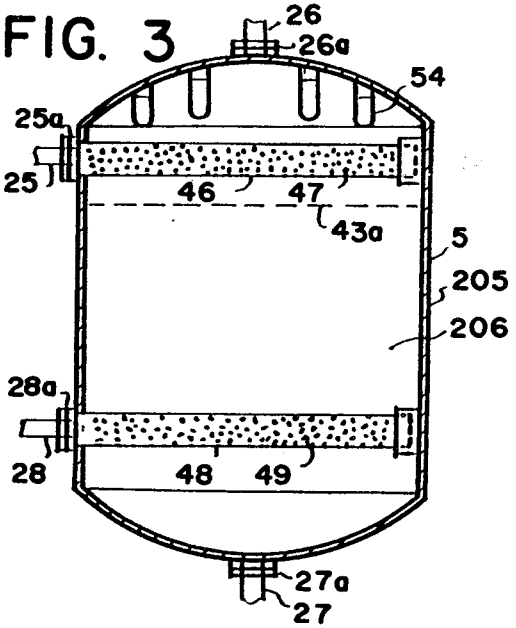
FIG. 3 is a view similar to that of FIG. 2 illustrating the other basic energy saving pressure vessel used in accordance with the invention.

It will be apparent that the vapor and condensate distributors shown in FIGS. 2 and 3 may be of other suitable distributing shapes that will effect adequate dispensing of the fluids involved within the respective vessels for purposes of condensing the vapor in same.

Referring to FIG. 5A, it shows that line 37 contains an additional pressure vessel 204, pump 90, valve 70, and check valve 170, downstream of heat exchanger 303. A vapor balance line 311 entends from vapor generator 202 to pressure vessel 204. Line 311 contains valve 71 and check valve 171. Line 312 extends from the three-way valve 70 to line 311.

Referring to FIG. 1, it shows an alternate system which is similar to the system shown on FIG. 5. The operations of the two systems are identical in many ways. Line 25*b* extends from liquid receiver or tank 200 to pressure vessel 5*e*. It serves as a liquid supply line. Line 25*b* contains pump 1, check valve 100*d*, heat exchanger 302*a*, a valve 33*d* and check valve 33*n*. Line 26*b* extends from line 25*b* to tank 200, line 26*b* contains valve 31*d* and check valve 31*n*. Line 25*c* extends from line 25*b* to pressure vessel 5*d*. Line 25*b* contains valve 32*d* and check valve 32*n*. Line 29*b* extends from the high pressure apparatus 202 (may be a vapor generator) to the top of pressure vessel 5*d*. Line 29*b* contains 35*d* and check valve 36*n*. Line 29*b* serves as a high pressure vapor supply line. Line 29*c* extends from line 29*b* to the top of pressure vessel 5*e*. Line 29*b* contains valve 37*d* and check valve 37*n*. Line 28*b* extends from line 29*b* to vessel 5*e*. Line 28*b* contains valve 35*d* and check valve 35*n*. Line 28*c* extends from line 29*c* to pressure vessel 5*d*. Line 38*c* contains valve 34*d* and check valve 34*n*. Line 27*b* extends from the bottom of vessel 5*d* to apparatus 202. Line 27*b* contains valve 38*d*, check valve 38*n*, pump 3, heat exchanger 303*a*, and modulating control valve 40*d*. Line 27*b* serves as a liquid feeding line. Line 27*e* extends from the bottom of vessel 5*e* to line 27*b*. Line 27*c* contains valve 39*d* and check valve 39*n*. The end of line 25*b* or line 25*c* may be connected to the inlet of a condensate distribution. The end of line 28*b* and 28*c* may be connected to a vapor distributor.

Referring to FIG. 1A it shows a center section of a nozzle like flow modifier which is used to reduce the impact of high velocity, high pressure vapor in a pipe.

Referring to FIG. 1B it shows a partial alternate of system A. Pump 3 pumps the liquid (or condensate) into a extended pipeline 320. Line 27*b* extended to pipeline 320. Line 27*b* contains control valve 40*d*.

Referring to FIG. 1C, line 29*b* extends from another high pressure vapor source instead of apparatus 202 to pressure vessel 5*d*. Line 29*c* extends from line 29*c* to pressure vessel 5*e*.

Figure 6:
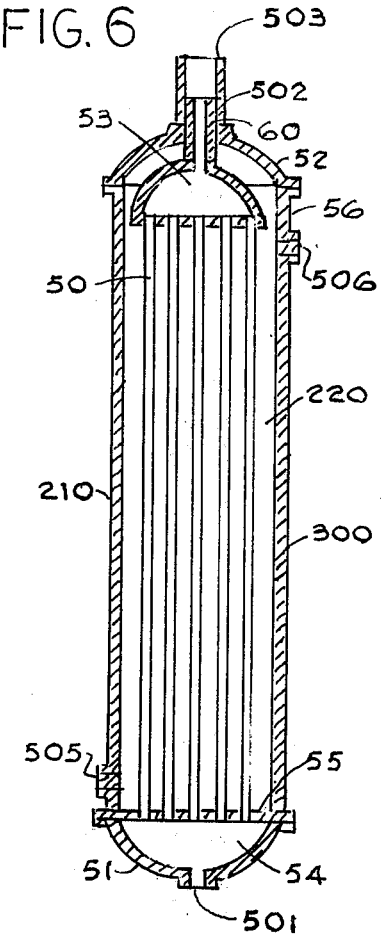
FIG. 6 is a diagrammatic elevational and sectional view of a heat exchanger according to the invention.

Referring to FIG. 6, the expansion absorbing heat exchanger 300 consists of heating tubes 50, a main shell 210, an end shell is connected to a opening 501. The end shell 52 at the other end is connected to an expansion joint 60 which consists of tube 502 and tube 503 which is the exterior tube of the two tube type expansion joint. Tube 502 is connected with fluid cell (or chamber) 53. Each heating tube 50 is connected and fastened to an opening of plate 55 and a opening of plate 56. Opening 505 and 506 at shell 210 are for pipe connection. All end openings of all heating tubes 50 are open to either cell 53 or cell 54. Cell 53 and plate 56 are movable inside shell 210 to absorb expansion of the heating tubes.

The heat exchanger can be constructed with carbon steel or stainless steel, capable to withstand the required operating pressure up to 8,000 PSIG. It is understood that cell 53 and expansion joint 60 can be used at both end of the heat exchanger.

Figure 6A:
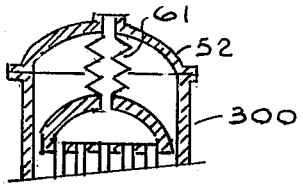
FIG. 6A is a fragmental sectional view showing a modification of the embodiment of FIG. 6.
Figure 6B:
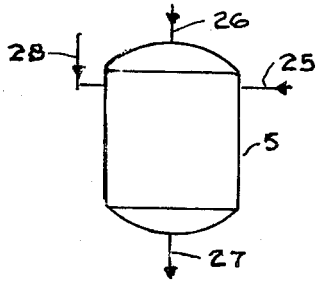
FIG. 6B is a fragmental sectional view showing a modification of the embodiment of FIG. 6.

FIG. 6A is a partial alternate of that shown in FIG. 6. A billow type expansion joint 61 is used in place of tube type expansion joint 60. The expansion joint 61 can be made by stainless steel.

Figure 7:
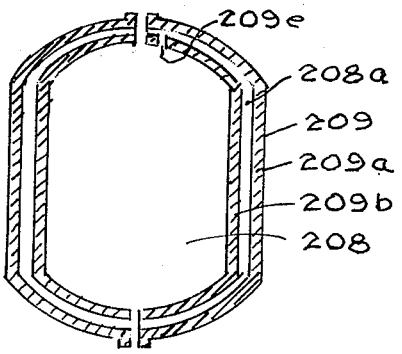
FIG. 7 is a diagrammatic elevational and sectional view of a shell composed of an interior and an exterior shell.

Referring to FIG. 7, the shell 209 of disclosed high pressure apparatus (a pressure vessel, a heat exchanger, etc.) is at least consists of two layers of shell. The internal shell 209*b* is 1/16" to ½" thick, made of stainless steel or carbon steel, shell 209*b* takes a sudden expansion or extraction. The exterior shell 209 shall be capable of withstanding the operating pressure up to 8,000 PSIG. It can be made with carbon steel. The space 208*a* is a space for pressure balancing liquid, the liquid space absorbing a sudden expansion of shell 209*b*. The shell 209 can be used for pressure vessel 5 and 6 and heat exchanger 300 utilized in this disclosure to replace the single shell.

The liquid space should be open to chamber 208 in most cases. The sudden increased pressure in chamber 208 might crack shell 209*b*. To prevent the cracking, the opening 209*e* at the upper part of shell 209*b* is utilized to balance the pressure between chamber 208 and space 208*b* and to release liquid in space 208*a* in case of overflowing. The liquid (can be water in most cases) prevent shell 209*a* to have the direct contact of hot steam or cold liquid in chamber 208 (except a little portion of shell 209*a*) and so, no sudden expansion or extraction can occur to at least most part of the inner surface of shell 209*a*.

Figure 7A:
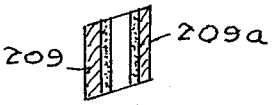
FIG. 7A is a fragmental sectional view showing a variation in the embodiment of FIG. 7.

Referring to FIG. 7A, the sectional view of a insulated shell presents an alternate of shell 209*a* or 209*b*. The insulation 209*d* and 209*e* should be sealed in a metal sheet (preferable stainless steel).

The vapor impact moderators, as shown in FIG. 1, (29*f*, 29*g* on line 29*b*, 29*h*, 29*i* on line 29*c*, 28*f*, 29*g* on line 28*b*, and 28*h*, 28*i* on line 28*c*), represent 2 or more moderator in series on a high pressure vapor releasing line. An adequate distance should be between two moderators. The moderators can be used upstream or downstream of a valve. It is understood a single modulator can be used on a pipe line. The application of the moderator can be used in the system shown on FIG. 5, or on any high pressure vapor line wherever it is required.

In operating the sytem shown in FIG. 5, the condensate accumulating in the equipment involved (for instance, a condensate tank), represented by vessel 200, and which is to be supplied to the vapor generator 202 by the practice of the invention, is pumped by the pump 1 from the vessel 200 through the line 25 into the distributor 46 of pressure vessel or receiver 5. The condensate passes through the distributor openings 47 into the chamber 206 defined by wall structure 205 to fill the vessel 5 up to the primary liquid level 43*a*. An automatic air vent arrangement of a suitable type is provided for receivers 5 and 6; same air vents are arranged to automatically release the air contained within the receivers 5 and 6 when the receiver involved is being charged with condensate in the first operating cycle. This may be done in any suitable manner. After the first cycle the receiver 5 is filled with vapor and then the receiver 5 is charged with condensate. The relatively cooler condensate shall cool the vapor through the distribution of distributor 46, and thus both the vapor pressure in the receiver and the pumping energy consumption are reduced.

When the liquid level 43*a* is reached in receiver 5, pumping is discontinued, and this may be achieved by employing a timer or suitable sensing device 1*a* which operates to discontinue the pumping action of the pump 1 when the level 43*a* is reached.

The heating fluid which may be steam at 270 degrees F., is introduced into the condensate now within the vessel 5 through line 28 and the perforated tube 48, and valve 13 is closed. The temperature of the condensate within receiver 5 will thereby be raised for example from approximately 180 degrees F. to approximately 230 degrees F. During the filling of the receiver 5 and the heating of the condensate, the valves 12 and 20 are closed so that no liquid or vapor escapes from the receiver 5. The valve 12 is opened briefly (about two to four seconds) to release to the atmosphere air trapped in receiver 5, when the condensate reaches approximately 230 degrees F.

After the condensate of receiver 5 has been heated to approximately the temperature level indicated and trapped air has been released, valve 14 is opened to balance the pressures of receivers 5 and 6 (except for the first operating cycle of the system, there is high pressure steam remaining in receiver 6 from the previous cycle); the valve 15 is opened, and the condensate is pumped from the receiver 5 through line 27 into heat exchanger 302 to force the heated condensate, which may be, for example, of approximately 300 F. in the heat exchanger into receiver 6, and specifically, through its distributor 44. The condensate is discharged through the distributor openings 45 into the chamber 207 defined by wall structure 203 of receiver 6. During the flow of condensate through line 27, the valve 14 of line 31 is opened so that the pressure of receivers 5 and 6 remains equalized. After the condensate in receiver 6 reaches the level indicated at 43, the receiver 6 is isolated from receiver 5 by closing the valves 14 and 15. Heating fluid, for example, in the form of steam at approximately 400 degrees F. is then introduced into the condensate in receiver 6 through lines 34 and 29, by opening valve 16, and it discharges into said receiver 6 through its tube 40 and its openings 41. By this procedure the temperature of the condensate in vessel 6 is raised, for example, from approximately 300 degrees F. to approximately 380 degrees F. During this period the valves 17, 18 and 19 remain closed.

Valve 20 may be opened to release vapor from receiver 5 for outside processing after said receiver is drained. This reduces the pressure inside receiver 5, and thus reduces the power requirements of pump 1.

To equalize the vapor pressure between the vapor generator 202 and the receiver 6, vapor from the vapor generator 202 is bled into the line 33 by opening valve 17. This high pressure vapor passes into tube 40 and is discharged through the openings 41 in the tube 40 and imposes on the condensate in vessel 6 a pressure approximately equal to the existing within the vapor generator.

It is understood that the high pressure vapor is not limited by its source. It can be bled from any adequate source, and it can be bled into the receiver without passing through a distributor to impose a vapor pressure in said receiver.

It is now possible to pump the heated condensate from the vessel 6 to the heat exchanger 303 to force the heated condensate of approximately 550 degrees F. into the vapor generator 202. At this point, the valve 18 is opened and the pump 3 is actuated to pump the condensate into the heat exchanger 303.

After the receiver 6 has been drained, valves 17 and 18 are closed and the valve 19 may be opened to release vapor from the receiver 6 for external work of any useful character.

Figure 4B:
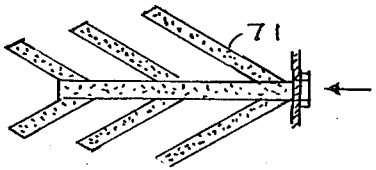
FIG. 4B is a fragmental view showing a variation in the embodiment of FIG. 2 and FIG. 3.
Figure 4A:
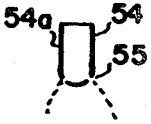
FIG. 4A is a diagrammatic sectional view taken substantially along line 4A—4A of FIG. 4.
Figure 4:
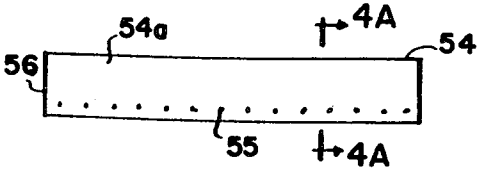
FIG. 4 is a fragmental elevational view of a liquid fluid sprinkling arrangement employed in the vessels of FIGS. 2 and 3.

FIG. 4B shows a fluid distributor 71 with multiple branches. It can be a vapor distributor or a liquid (or condensate) distributor.

In operating the system shown in FIG. 1 (system A), pressure vessels, "or receivers" **5*d* and 5*c* are of the same construction as shown on FIGS. 2 and 4B**.

The condensate accumulating in the equipment involved (for instance, a condensate tank), represented by vessel 200, and from which condensate is to be supplied to the vapor generator 202 (a steam generator in this case), condensate is pumped by the pump 1 from the vessel 200 through the lines **25*b* and 25*e* into the distributor 46 of receiver 5*d*. The condensate at 190 degrees F. passes through the distributor openings 47 into the chamber 206 defined by wall structure 205 to fill the vessel 5*d* up to the primary liquid level 43*a*. An automatic air vent arrangement of a suitable type is provided for receivers 5*d* and 5*e*; same air vents are arranged to automatically release the air contained within the receivers 5*d* and 5*e* when the receiver involved is being charged with condensate in the first operating cycle. This may be done in any suitable manner. After the first cycle the receiver 5*d* is filled with steam at 208 degrees F. and then the receiver 5*d* is charged with condensate. The relatively cooler condensate shall cool the steam through the distribution of distributor 46**, and thus both the vapor pressure in the receiver and the pumping energy consumption are reduced, and the condensate is heated from 190 degrees F. to 200 degrees F.

When the liquid level **43*a* is reached in receiver 5*d*, pumpng is discontinued, and this may be achieved by employing a timer or suitable sensing device 1*a* which operates to discontinue the pumping action of the pump 1 when the level 43*a*** is reached.

Vessel **5*e* is filled with high pressure steam at 540 degrees F. (except first operating cycle). Valve 34*d* is open to release high pressure vapor from vessel 5*e* into vessel 5*d* after modulators, add through one or more vapor impact modulators, and distributor 48 to inject the vapor into the condensate in vessel 5*d* for condensating most of the vapor and thus the condensate is heated from 200 degrees F. to 225 degrees F. And then valve 34*d* is closed and valve 30*d* is open to release 1,000 PSIG. steam from vapor generator 202 into vessel 5*d* to impose a high pressure head in vessel 5*d*. And then valve 38*d* is open and pump 3 pumps the heated condensate from vessel 5*d* into vapor generator 202 with little energy consumption. Valve 40*d* is used to control liquid volume. The operations of vessel 5*d* and 5*e* are the same. The two vessels operate in an order of rotation. Pump 3 and pump 1 are in continuous operation. For example, both valves 38*d* and 39*d* open approximately 72 seconds each cycle. Two seconds before one valve (38*d* or 39*d*) is closed, the other correspondent valve starts to open. Valve 32*d*, 33*d* and 31*d* operate in an order of rotation to keep pump 1 in continuous operation. Both valve 32*d* and 33*d* open 57 seconds in one cycle, and valve 31*d* opens 32 seconds each cycle to release condensate back to vessel 200. Two seconds before one valve is closed the other valve starts to open. More than two pressure vessels can be used in this system. If three or more vessels are used, line 26*b* and valves 31*n* and 31*d*** can be removed. In this operation after the condensate in one vessel is drained, the high pressure steam is then released to another pressure vessel in which the condensate has reached the liquid level.

More than one condensate distributor or vapor distributor can be used in one pressure vessel (only one shown in FIGS. 1, 5 and 5A), and one distributor may have more than one branch.

Referring to FIGS. 5, and 5A, an operation of system B in which one or more vapor distributors is deposed in each pressure vessel, "vessel 5 or 6", this operation is similar with the operation stated in previous pages related to FIG. 5. No vapor distributor is used. In the operation, after vessel 6 is drained, valve 17 or 16 is closed (if both valves are used, both valves are now closed). And then valve 14 is open to release high pressure steam from vessel 6 into the top portion of vessel 5 (above liquid level) for balancing the pressure head between these two vessels and then pump 2 pumps the condensate in vessel 5 into vessel through one (or more) condensate distributor with multi-branches (in some cases" single straight tube type can be used) to inject the cooler condensate (200 degrees F.) into the hot steam (540 degrees F.) to condense a big portion of the steam and reduce the steam pressure in vessel 5 and 6. The condensate is heated from 200 degrees F. to 225 degrees F. And then, valve 14 is closed and pumps 2 stops to operate after vessel 5 is drained. No heating steam is released into any pressure vessel for heating the condensate.

The steam in the steam generator 202 is 545 degrees F. After valve 17 is open to release high pressure steam into vessel 6, pump 3 pumps condensate from vessel 6 into two heat exchangers 303 in series and to push the heated condensate from the exchangers into steam generator 202. The exchangers heat the condensate from 225 degrees". Heat exchanger 300 type can be used as exchangers 303 and 302". to 400 degrees F. The heat exchanger 302 is not utilized in this case. The rest of the operation is similar with system B stated in previous pages (not utilizing all heat exchangers). Two or more sets of the systems shown in FIG. 5, 4B can be used in an order of rotation to insure a continuous operation of pump 3.

The heat exchanger 300 can be a high, medium or low pressure heat exchanger.

The term "pump 3 pumps condensate into the vapor generator" includes all the ways that can be used to pump condensate into said generator 202 directly or indirectly. The indirect way means that the pump pumps the condensate into a pressure vessel and from that vessel the condensate is drained or pumped into the generator as shown in FIG. 5A. If the said vessel is used and the vessel has enough capacity of storage, the generator can receive a continuous condensate supply without using the suggested rotational methods described. Quite a number of minor changes may be employed as desirable or necessary, to meet a particular need but the basic principles of the methods herein disclosed are the same. The term high pressure vapor used in this disclosure includes all types of vapor utilized, which have at least 50 psig. operating pressure. The generator can be a heat exchanger or a boiler.

The piping and the valves used in accordance with the invention shall be such as to withstand the pressures and temperatures of the operational conditions encountered. Stainless steel can be used in a delicate rust free operation. Steel pipe manufacturers provide all particular details for any particular requirement.

The term "generator", "a pump", "a tank", "a heat exchanger", and "a vessel" as used herein indicates at least one of such equipment, but these terms are not limited to mean just one equipment component thereof.

When a distributor is used to distribute relatively cooler condensate into a receiver, said condensate can cool the relatively hotter vapor therein, and thus the vapor is cooled and the vapor pressure is immediately reduced. This operation is used to reduce the condensate pumping energy by reducing the pump pressure head requirements.

The foregoing description and the drawings are given merely to explain and illustrate the invention and the invention is not to be limited thereto, except insofar as the appended claims are so limited, since those skilled in the art who have the disclosure before them will be able to make modifications and varaiations therein without departing from the scope of the invention.

What I claim is:

1. A high efficiency energy saving condensate feeding system for feeding condensate into a high pressure vapor generator of more than 80 PSIG vapor pressure, comprising a first high pressure vessel with an expansion adjustable internal shell and an external shell and a second high pressure vessel filled with the same find of vapor as is generated by said generator and said vapor in said first vessel being high pressure vapor, a high pressure vapor source, means for changing condensate into said second vessel to fill said second vessel up to a substantial liquid level in said second vessel, means for selectively isolating said second vessel, a vapor distributor with multiple openings under the liquid level in said second vessel, means for releasing high pressure vapor in said first vessel into said second vessel and to inject said vapor into the condensate in said second vessel through said vapor distributor for reducing the vapor pressure by condensing a portion of said vapor, means for charging said condensate from said second vessel into said first vessel, means for isolating said first vessel from said second vessel, means for bleeding high pressure vapor from said high pressure vapor source into said first vessel to build up a pressure head in said first vessel for assisting condensate feeding into said generator, means for charging said condensate from said first vessel into said generator until said first vessel is selectively drained while said vapor bleeding means is selectively in operation; and means for selectively isolating said first vessel from said high pressure vapor source.

2. A system according to claim 1, comprising a condensate distributor with multiple openings disposed in said second vessel; and means for charging relatively cooler condensate into said second vessel and to inject said condensate through said multiple openings of said condensate distributor into the vapor in said second vessel to condense a portion of said vapor for reducing the vapor pressure.

3. A system according to claim 1, comprising a condensate distributor with multiple openings disposed in said first vessel, and means for charging relatively cooler condensate from said second vessel into said first vessel and to inject said condensate into said vapor in said first vessel through said multiple openings of said condensate distributor to condense a portion of said vapor for reducing the vapor pressure.

4. An energy saving method for feeding condensate into a high pressure vapor generator of more than 85 psig vapor pressure, comprising:

providing a first, a second and a third energy saving high pressure vessel, having at least one high pressure condensate distributor with multiple openings disposed in said first vessel and filling said vessels with the same kind of vapor as is generated by said generator, and the vapor in said first vessel being high pressure vapor of which at least most of the energy content is to be restored to said generator;

charging condensate into said second vessel and filling the second vessel up to a substantial liquid level in said second vessel;

selectively isolate said second vessel;

releasing said high pressure vapor in said first vessel into said second vessel;

charging said condensate from said second vessel into sid first vessel through said condensate distributor for distributing relatively cooler condensate into the vapor in said first vessel for condensing a portion of said vapor;

isolating said first vessel selectively from said second vessel;

bleeding high pressure vapor from a high pressure vapor source into said first vessel and building a pressure head in said first vessel;

charging said condensate into said third vessel; and charging said condensate from said third vessel into said vapor generator.

* * * * *